US012188711B2

(12) United States Patent
Lyu et al.

(10) Patent No.: US 12,188,711 B2
(45) Date of Patent: Jan. 7, 2025

(54) REFRIGERATOR

(71) Applicants: HEFEI HAIER REFRIGERATOR CO., LTD, Anhui (CN); HAIER SMART HOME CO., LTD., Shandong (CN)

(72) Inventors: Peng Lyu, Shandong (CN); Hao Zhang, Shandong (CN); Wenchun Wang, Shandong (CN)

(73) Assignees: HEFEI HAIER REFRIGERATOR CO., LTD, Anhui (CN); HAIER SMART HOME CO., LTD., Shandong (CN)

( * ) Notice: Subject to any disclaimer, the term of this patent is extended or adjusted under 35 U.S.C. 154(b) by 92 days.

(21) Appl. No.: 18/029,223

(22) PCT Filed: Sep. 17, 2021

(86) PCT No.: PCT/CN2021/119073
§ 371 (c)(1),
(2) Date: Mar. 29, 2023

(87) PCT Pub. No.: WO2022/083373
PCT Pub. Date: Apr. 28, 2022

(65) Prior Publication Data

US 2023/0375251 A1 Nov. 23, 2023

(30) Foreign Application Priority Data

Oct. 19, 2020 (CN) ..... 202011116971.4

(51) Int. Cl.
*F25D 23/02* (2006.01)

(52) U.S. Cl.
CPC ..... *F25D 23/028* (2013.01); *F25D 2323/021* (2013.01); *F25D 2400/06* (2013.01)

(58) Field of Classification Search
CPC .. F25D 23/028; F25D 23/02; F25D 2323/021; F25D 2400/06; F25D 23/087
See application file for complete search history.

(56) References Cited

U.S. PATENT DOCUMENTS 3,327,701 A 6/1967 Smith
9,995,528 B1 * 6/2018 Ebrom ..... H04N 23/64
(Continued)

FOREIGN PATENT DOCUMENTS

CN 105066551 A 11/2015
CN 105066556 A 11/2015
(Continued)

OTHER PUBLICATIONS

Chinese Intellectual Property Office (ISR/CN), "International Search Report for PCT/CN2021/119073", China, Dec. 1, 2021.
(Continued)

*Primary Examiner* — Kimberley S Wright
(74) *Attorney, Agent, or Firm* — Locke Lord LLP; Tim Tingkang Xia, Esq.

(57) ABSTRACT

A refrigerator, comprising a refrigerator body (30), a first door body (10), a second door body (20), a vertical beam (50), and a driving mechanism (60). The driving mechanism (60) comprises a telescopic member (61) that may be at an extension position or at a retraction position; an elastic member (62); a rotating member (63) rotatable around a second vertical axis and a third vertical axis (X3), with a sliding channel (631) formed thereon; and a sliding column (64). During the closing of the first door body (10) from an open state, the telescopic member (61) moves towards the retraction position from the extension position to drive the rotating member (63) to rotate around the second vertical axis (X2), so that the sliding channel (631) pushes the
(Continued)

sliding column (64) to drive the vertical beam (50) to rotate from a folded state to an unfolded state.

10 Claims, 4 Drawing Sheets

(56) References Cited

U.S. PATENT DOCUMENTS

| | | | | |
|---|---|---|---|---|
| 2012/0073321 | A1 | 3/2012 | Davis et al. | |
| 2014/0375198 | A1* | 12/2014 | Jeon | F25D 25/02 312/405 |

FOREIGN PATENT DOCUMENTS

| | | | | |
|---|---|---|---|---|
| CN | 106152687 | A | 11/2016 | |
| CN | 106322901 | A | 1/2017 | |
| CN | 111059828 | A | 4/2020 | |
| JP | H1054648 | A | 2/1998 | |
| JP | 3273865 | B2 | 4/2002 | |
| WO | 2007115868 | A2 | 10/2007 | |
| WO | WO-2009083406 | A2 * | 7/2009 | F25D 23/02 |

OTHER PUBLICATIONS

EPO, "Supplementary European Search Report for EP Application No. 21881792.2", Hague, Germany, Jan. 12, 2024.

* cited by examiner

REFRIGERATOR

CROSS-REFERENCE TO RELATED PATENT APPLICATION

This application is a U.S. national stage application of PCT Patent Application No. PCT/CN2021/119073 filed Sep. 17, 2021, which claims priority to and the benefit of Chinese Application No. 202011116971.4 filed Oct. 19, 2020, which are incorporated herein in their entireties by reference.

FIELD OF THE INVENTION

The present invention relates to a refrigerating and freezing apparatus, and in particular relates to a refrigerator.

BACKGROUND OF THE INVENTION

Large capacity refrigerators usually adopt a left-right double-door structure, wherein a vertical beam for sealing is mounted on a door body, to prevent cold air from leaking through a gap between the two door bodies. When the door body is opened, the vertical beam is in a state approximately perpendicular to the door body, that is, a folded state. During the closing of the door body, the vertical beam is rotated along a vertical axis to be approximately parallel with the door body, that is, an unfolded state, so as to seal the gap between the door body and the other door body. Generally, a storage compartment is provided with a guide groove opening downwards on the top wall thereof, a guide member protruding upwards is disposed at the top or bottom of the vertical beam, and during the process of opening or closing a door, the guide member moves along an extending path of the guide groove to guide the vertical beam to rotate correctly.

However, due to the friction between the guide member and the guide groove and other factors, the above solution usually leads to jamming and shaking of the vertical beam during rotation, resulting in poor rotation of the vertical beam, and thus a user has a poor experience when closing the door. Moreover, due to the configuration of the guide member and the guide groove, the sealing performance between the top/bottom of the vertical beam and the top wall/bottom wall of the storage compartment is also poor. In addition, the appearance of the refrigerator is also affected by the configuration of the guide groove and the guide member.

BRIEF DESCRIPTION OF THE INVENTION

An objective of the present invention is to overcome at least one of the above defects of the prior art, and to provide a refrigerator in which a vertical beam can rotate automatically during a door opening or closing process without configuring a guide member and a guide groove.

An objective of the present invention is to improve the smoothness of rotation of the vertical beam, avoid jamming of the vertical beam during rotation, and improve the sealing performance between the vertical beam and an inner wall of a storage compartment.

In particular, the present invention provides a refrigerator, including a refrigerator body with an open front side, a first door body and a second door body that are rotatably disposed on the front side of the refrigerator body in a side-by-side manner, a vertical beam that is mounted at an open end of the first door body to be rotatable around a first vertical axis, and at least one driving mechanism, wherein the driving mechanism includes:

a telescopic member, telescopically mounted on the first door body in the thickness direction of the first door body, to be at an extension position where the rear end of the telescopic member projects and extends out of the surface of the inner side of the first door body, or at a retraction position of retracting from the extension position to the interior of the first door body by a preset distance;

an elastic member, configured to apply an elastic force to the telescopic member to prompt same to move towards the extension position;

a rotating member, mounted on the first door body to be rotatable around a second vertical axis, and mounted on the telescopic member to be rotatable around a third vertical axis, wherein a sliding channel is formed in the rotating member; and a sliding column, directly or indirectly fixed to the vertical beam and slidable along the sliding channel. The refrigerator is configured such that when the first door body is in an open state, the telescopic member is at the extension position, and the vertical beam is in a folded state attached to the inner side of the first door body; and during the closing of the first door body, the telescopic member is blocked by the refrigerator body and moves to the retraction position, to drive the rotating member to rotate around the second vertical axis, so that the sliding channel pushes the sliding column to drive the vertical beam to rotate to an unfolded state, so as to seal a gap between the first door body and the second door body.

Optionally, the driving mechanism further includes a connection rod, the connection rod is fixedly connected to the vertical beam and extends in a direction away from the vertical beam, and the sliding column is mounted at the end, away from the vertical beam, of the connection rod.

Optionally, the end, close to the vertical beam, of the connection rod is rotatably mounted on the first door body so that the vertical beam rotates around the first vertical axis.

Optionally, the telescopic member, the rotating member and the connection rod are arranged in the vertical direction in a staggered manner.

Optionally, the second vertical axis, the third vertical axis and a central axis of the sliding column are coplanar, and the second vertical axis is located between the third vertical axis and the sliding channel.

Optionally, the refrigerator is configured such that when the vertical beam is in the folded state, the sliding column abuts against the end, away from the second vertical axis, of the sliding channel in the length direction.

Optionally, a ratio of the distance between the end, away from the second vertical axis, of the sliding channel in the length direction and the second vertical axis to the distance between the third vertical axis and the second vertical axis is greater than 5.

Optionally, the rotating member includes an oblong ring part, and the sliding channel is formed on the inner side of the ring part.

Optionally, the telescopic member is provided with two lugs extending away from each other in the width direction of the first door body; the first door body is provided with two limit grooves to accommodate the two lugs respectively; there are two elastic members and both are compressed springs, each elastic member is connected between the rear surface of one lug and the rear wall of the corresponding limit groove, and when the telescopic member is in an extending state, the lugs abut against the front walls of the limit grooves under the action of the elastic forces of the elastic members.

Optionally, there are two driving mechanisms, and the two driving mechanisms are matched with the top and the bottom of the vertical beam respectively.

The refrigerator provided by the present invention adopts an innovative driving mechanism to realize correct rotation of the vertical beam, and the solution of using a guide member and a guide groove to guide rotation of the vertical beam commonly used in the field of refrigerators is abandoned, thereby avoiding the problems of jamming and shaking of the vertical beam during rotation and poor rotation caused by the friction between the guide member and the guide groove and other factors. During the closing of the first door body, the telescopic member is blocked by the refrigerator body and moves to the retraction position, to drive the rotating member to rotate around the second vertical axis, so that the sliding channel pushes the sliding column to drive the vertical beam to rotate to the unfolded state. During the opening of the first door body, the telescopic member moves towards the extension position under the action of the elastic force of the elastic member, to drive the rotating member to rotate, so that the sliding channel pushes the sliding column to drive the vertical beam to rotate to the folded state. According to the present invention, by means of the simple driving mechanism, the vertical beam can rotate automatically with an opening or closing action of the first door body, which has an extremely ingenious structure. Moreover, the top/bottom of the vertical beam can directly contact the top wall/bottom wall of a storage compartment without the configuration of the guide member and the guide groove, so that better sealing performance is achieved, and less cold is lost.

Furthermore, according to the refrigerator provided by the present invention, the second vertical axis, the third vertical axis and the central axis of the sliding column are coplanar, the second vertical axis is located between the third vertical axis and the sliding channel; and when the vertical beam is in the folded state, the sliding column abuts against the end, away from the second vertical axis, of the sliding channel in the length direction, and the ratio of the distance between the end, away from the second vertical axis, of the sliding channel in the length direction and the second vertical axis to the distance between the third vertical axis and the second vertical axis is greater than 5, which is to reduce the operation resistance of the driving mechanism, make the operation more smooth, and make a user close the door more effortlessly. At the same time, the telescopic member can complete one rotation of the vertical beam by moving a relatively small distance, which prevents the length of the telescopic member from exceeding the thickness of the first door body.

The above and other objectives, advantages, and features of the present invention will be better understood by those skilled in the art according to the following detailed description of specific embodiments of the present invention in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In the drawings.

DETAILED DESCRIPTION

A refrigerator according to an embodiment of the present invention will be described below with reference to FIGS. 1 to 6. The orientations or positional relationships indicated by "front," "rear," "upper," "lower," "top," "bottom," "inside," "outside," "transverse," etc. are based on the orientations or positional relationships shown in the accompanying drawings, only for the convenience of describing the present invention and simplifying the description, rather than indicating or implying that a device or an element referred to must has a particular orientation, and be constructed and operated in a particular orientation, and therefore cannot be construed as a limitation of the present invention.

Figure 1:
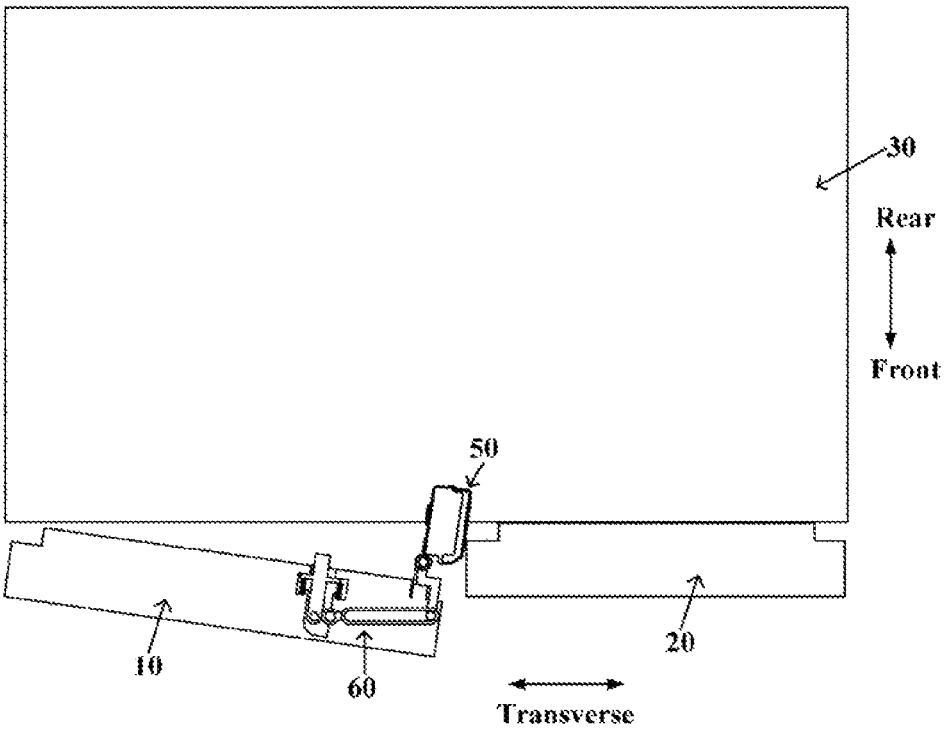
FIG. 1 is a schematic structural diagram of a refrigerator, when a first door body is in an open state, according to an embodiment of the present invention.
Figure 2:
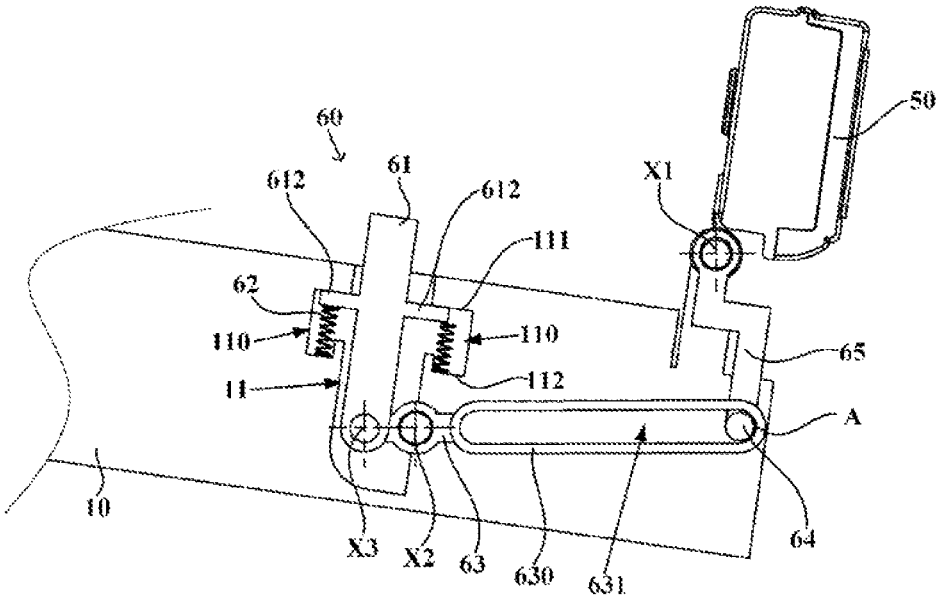
FIG. 2 is an enlarged schematic diagram of the first door body, a driving mechanism and a vertical beam in FIG. 1.
Figure 3:
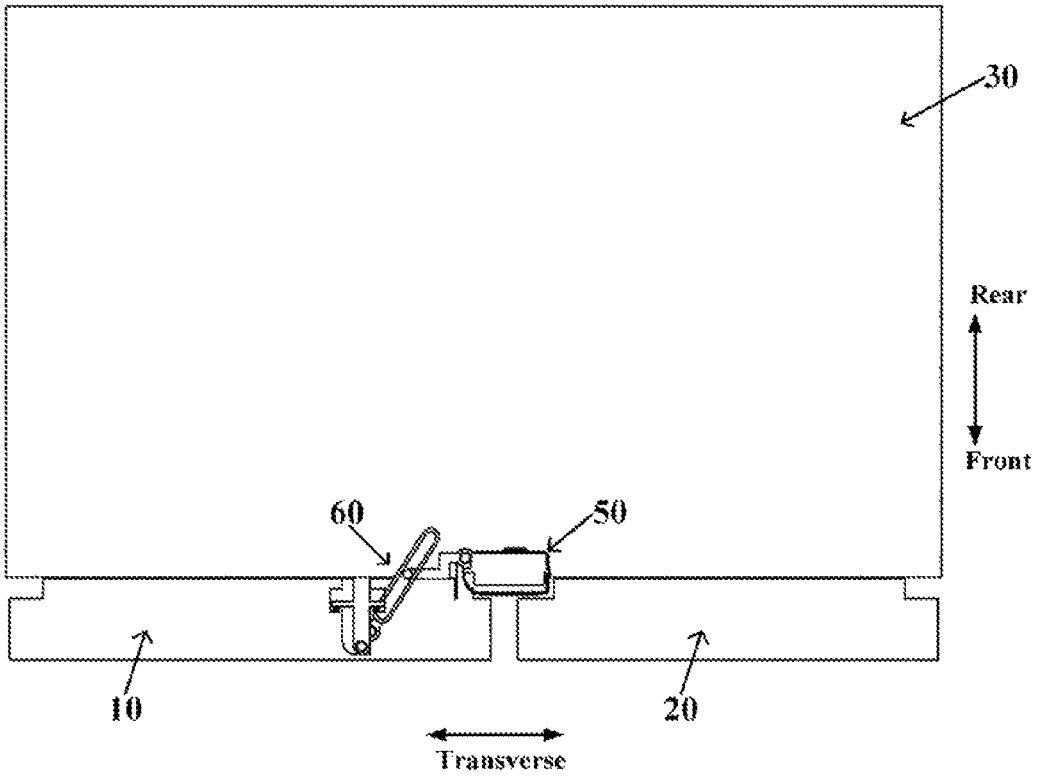
FIG. 3 is a schematic structural diagram of the refrigerator, when the first door body is in a closed state, shown in FIG. 1.
Figure 4:
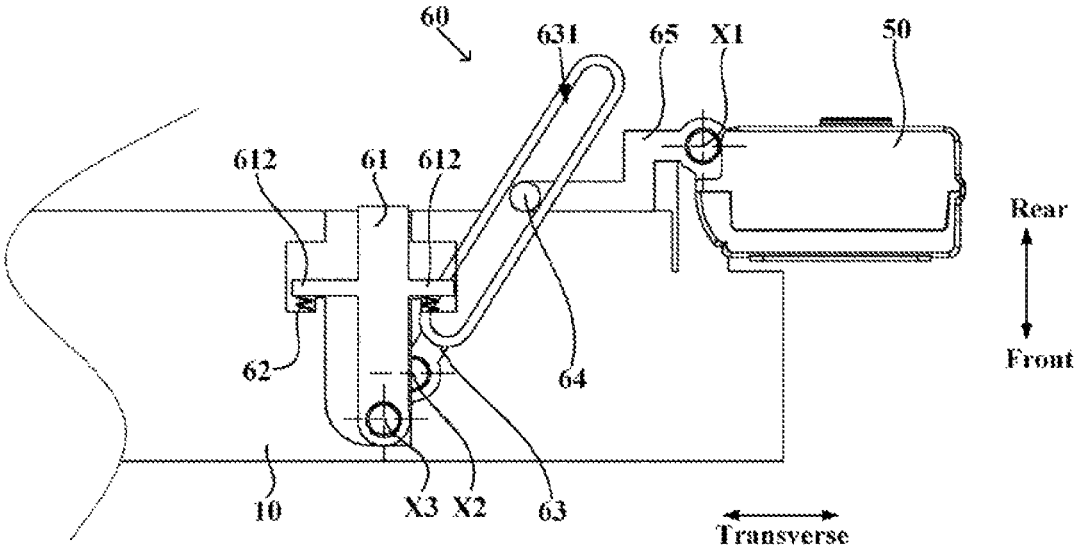
FIG. 4 is an enlarged schematic diagram of the first door body, the driving mechanism and the vertical beam in FIG. 3.

FIG. 1 is a schematic structural diagram of a refrigerator, when a first door body 10 is in an open state, according to an embodiment of the present invention; FIG. 2 is an enlarged schematic diagram of the first door body 10, a driving mechanism 60 and a vertical beam 50 in FIG. 1; FIG. 3 is a schematic structural diagram of the refrigerator, when the first door body 10 is in a closed state, shown in FIG. 1; and FIG. 4 is an enlarged schematic diagram of the first door body 10, the driving mechanism 60 and the vertical beam 50 in FIG. 3.

As shown in FIG. 1 to FIG. 4, an embodiment of the present invention provides a refrigerator. The refrigerator includes a refrigerator body 30 with an open front side, a first door body 10 and a second door body 20 that are rotatably disposed on the front side of the refrigerator body 30 in a side-by-side manner, a vertical beam 50 that is mounted at an open end of the first door body 10 to be rotatable around a first vertical axis X1, and at least one driving mechanism 60.

Figure 5:
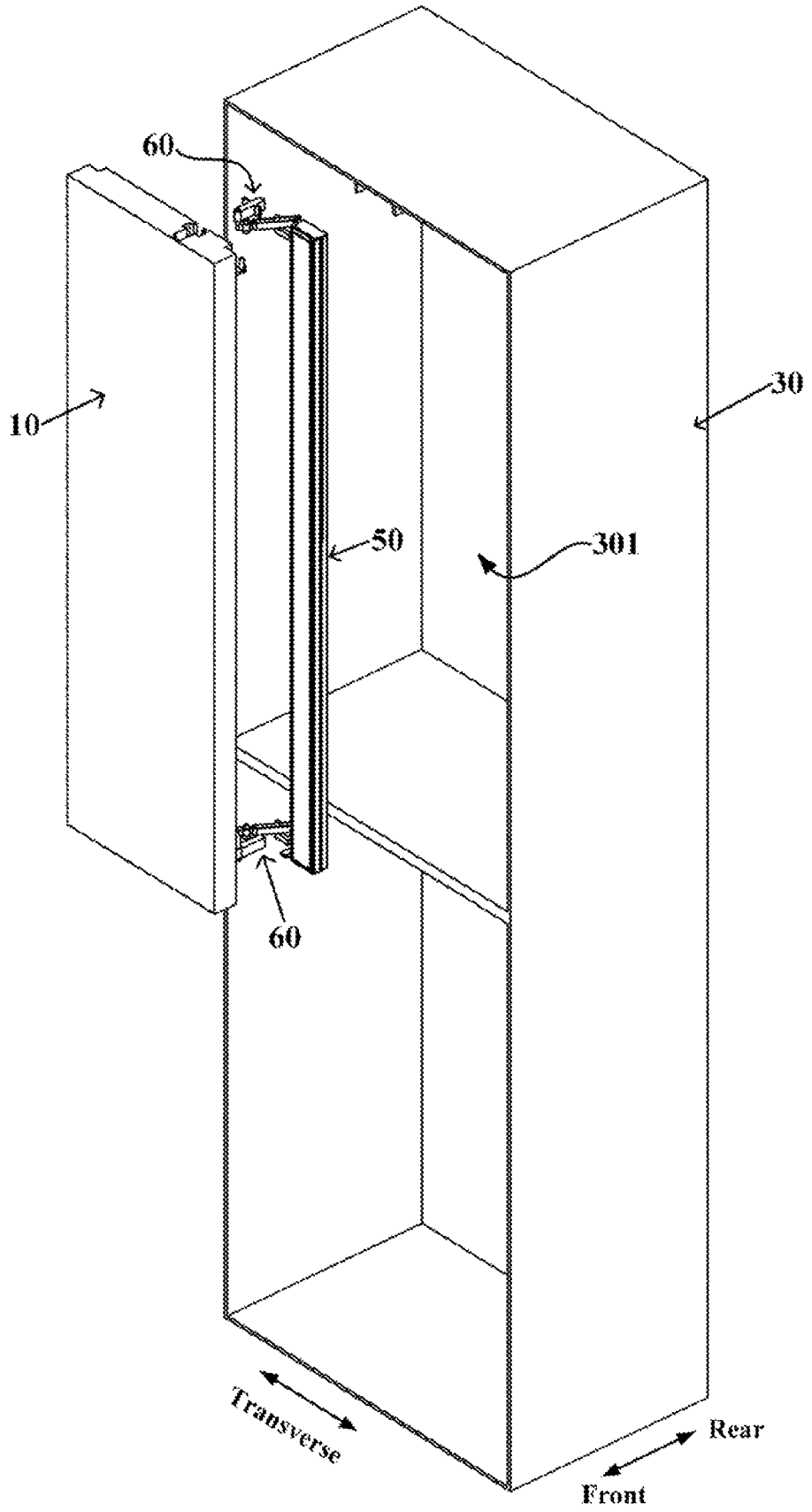
FIG. 5 is an exploded schematic diagram of a refrigerator body, the first door body, the vertical beam and the driving mechanism in FIG. 1.

The front side of the refrigerator body 30 is open, that is, a storage compartment 301 defined by the refrigerator body 30 is open forward (referring to FIG. 5). The first door body 10 and the second door body 20 are rotatably disposed on the front side of the refrigerator body 30 in a side-by-side manner. For example, in FIG. 1, the first door body 10 and the second door body 20 are arranged side by side along the transverse direction, and a pivot axis of the first door body 10 on the left is located on the left side of the first door body, and the right end of the same is the open end. A pivot axis of the second door body 20 on the right is located on the right side of the second door body, and the left side of the same is an open end.

The vertical beam 50 is rotatably mounted at the open end of the first door body 10. As shown in FIG. 3, when both the first door body 10 and the second door body 20 are in a closed state, the vertical beam 50 is attached to the surfaces of the inner sides of the two door bodies, so as to prevent cold air from leaking out of the refrigerator. As shown in FIG. 1, during the opening of the first door body 10, the vertical beam 50 rotates backwards, to rotate from an unfolded state approximately parallel to the first door body 10 to a folded state at a predetermined angle (for example, perpendicular to the first door body 10) with the first door body 10, so as to be away from the second door body 20, thereby preventing the vertical beam 50 from being blocked by the second door body 20 during the opening of the first door body 10. Similarly, during the closing of the first door body 10, the vertical beam 50 gradually rotates from the folded state to the unfolded state, to seal a gap between the two door bodies.

Those skilled in the art should understand that the vertical beam 50 can also be mounted on the second door body 20 instead of the first door body 10. However, for ease of description, the embodiment of the present invention only introduces the solution of mounting the vertical beam 50 on the first door body 10.

As shown in FIG. 2 and FIG. 4, each driving mechanism 60 includes a telescopic member 61, an elastic member 62, a rotating member 63 and a sliding column 64. The telescopic member 61 is telescopically mounted on the first door body 10 in the thickness direction (when the first door body 10 is in a closed state, the thickness direction is parallel to a front-rear direction) of the first door body 10, to be at an extension position (as shown in FIG. 2) where the rear end of the telescopic member projects and extends out of the surface of the inner side of the first door body 10, or at a retraction position (as shown in FIG. 4) of retracting from the extension position to the interior of the first door body 10 by a preset distance. The elastic member 62 is configured to apply an elastic force to the telescopic member 61 to prompt the same to move towards the extension position. That is, when the telescopic member 61 is at the retraction position, under the action of the elastic force of the elastic member 62, the telescopic member has a tendency to move towards the extension position. The rotating member 63 is mounted on the first door body 10 to be rotatable around a second vertical axis X2, and mounted on the telescopic member 61 to be rotatable around a third vertical axis X3, and a sliding channel 631 is formed in the rotating member 63. The sliding column 64 is directly or indirectly fixed to the vertical beam 50 and slidable along the sliding channel 631.

The refrigerator is configured such that when the first door body 10 is in the open state, the telescopic member 61 is at the extension position, and the vertical beam 50 is in the folded state attached to the inner side of the first door body 10, as shown in FIG. 1 and FIG. 2. During the closing of the first door body 10, the telescopic member 61 is blocked by the refrigerator body 30 and moves towards the retraction position, to drive the rotating member 63 to rotate around the second vertical axis X2, so that the sliding channel 631 pushes the sliding column 64 to drive the vertical beam 50 to rotate to the unfolded state, so as to seal the gap between the first door body 10 and the second door body 20, as shown in FIG. 3 and FIG. 4. During this process, the driving mechanism 60 drives the rotating member 63 to rotate by using movement of the telescopic member 61, and the rotation of the rotating member 63 drives the sliding column 64 to move, and finally drives the vertical beam 50 to rotate.

It should be understood that, during rotation and opening of the first door body 10, the telescopic member 61 is not blocked by the refrigerator body 30, and gradually extends out under the action of the elastic force of the elastic member 62, so that the rotating member 63 is driven to rotate around the second vertical axis X2, and thus the sliding channel 631 pushes the sliding column 64 to drive the vertical beam 50 to rotate to the folded state.

According to the embodiment of the present invention, by means of the simple driving mechanism 60, the vertical beam 50 can rotate automatically with an opening or closing action of the first door body 10, which has an extremely ingenious structure. Moreover, the top/bottom of the vertical beam 50 can directly contact the top wall/bottom wall of the storage compartment without the configuration of a guide member and a guide groove, so that better sealing performance is achieved, and less cold is lost. Furthermore, since the guide member and the guide groove are not needed, the problems of jamming and shaking of the vertical beam during rotation and poor rotation caused by the friction between the guide member and the guide groove and other factors can be avoided.

In some embodiments, as shown in FIG. 2 and FIG. 4, the driving mechanism 60 can further include a connection rod 65. The connection rod 65 is fixedly connected to the vertical beam 50 and extends in a direction away from the vertical beam 50, and the sliding column 64 is mounted at the end, away from the vertical beam 50, of the connection rod 65. Therefore, the sliding column 64 is away from the first vertical axis X1 of the vertical beam 50, so that a longer arm of force (that is, the distance between the sliding column 64 and the first vertical axis X1) is achieved, and thus the sliding column 64 can drive the vertical beam 50 to rotate even a less force is applied to the sliding column.

The end, close to the vertical beam 50, of the connection rod 65 is rotatably mounted on the first door body 10 so that the vertical beam 50 rotates around the first vertical axis X1. That is, the vertical beam 50 is mounted on the first door body 10 by means of the connection rod 65, and thus there is no need to additionally provide a rotatable connection structure on the vertical beam 50. The connection rod 65 and the vertical beam 50 may be separate components and are fixedly connected by a fastening structure. The connection 65 and a housing of the vertical beam 50 may also be integrally molded.

In some embodiments, as shown in FIG. 2 and FIG. 4, the second vertical axis X2, the third vertical axis X3 and a central axis of the sliding column 64 may be coplanar, and the second vertical axis X2 is located between the third vertical axis X3 and the sliding channel 631. The refrigerator is configured such that when the vertical beam 50 is in the folded state, the sliding column 64 abuts against the end, away from the second vertical axis X2, of the sliding channel 631 in the length direction, as shown in FIG. 2, and thus the vertical beam 50 is firmly maintained in the folded state when the telescopic member 61 is at the extension position. A ratio of the distance between the end (A end), away from the second vertical axis X2, of the sliding channel 631 in the length direction and the second vertical axis X2 (that is, the distance between A and X2) to the distance between the third vertical axis X3 and the second vertical axis X2 (that is, the distance between X2 and X3) is greater than 5, preferably greater than 7, so as to reduce the operation resistance of the driving mechanism 60, make the operation more smooth, and make a user close the door more effortlessly. At the same time, the telescopic member 61 can complete one rotation of the vertical beam 50 by moving a relatively small distance, which prevents the length of the telescopic member 61 from exceeding the thickness of the first door body 10.

In some embodiments, as shown in FIG. 2 and FIG. 4, the rotating member 63 includes an oblong ring part 630, and the sliding channel 631 is formed on the inner side of the ring part 630. The sliding column 64 may be cylindrical and has an outer diameter slightly less than the width of the sliding channel 631, so as to move in the length direction of the sliding channel 631. The sliding column 64 is mounted on the connection rod 65 to be rotatable around the central axis of the sliding column, so that the sliding column can roll along the inner wall of the sliding channel 631, to reduce sliding friction.

In some embodiments, as shown in FIG. 2 and FIG. 4, the telescopic member 61 is provided with two lugs 612 extending away from each other in the width direction of the first door body 10. The first door body 10 is provided with two limit grooves 110 to accommodate the two lugs 612 respectively. There are two elastic members 62 and both are compressed springs, and each elastic member 62 is connected between the rear surface of one lug 612 and the rear wall 112 of the corresponding limit groove 110. When the telescopic member 61 is in an extending state, the lugs 612 abut against the front walls 111 of the limit grooves 110 under the action of the elastic forces of the elastic members 62. The first door body 10 can be provided with a sliding way 11, and the telescopic member 61 is slidably mounted into the sliding way 11, to achieve telescopic movement. The two limit grooves 110 are located on two sides of the sliding way 11 in the width direction.

Figure 6:
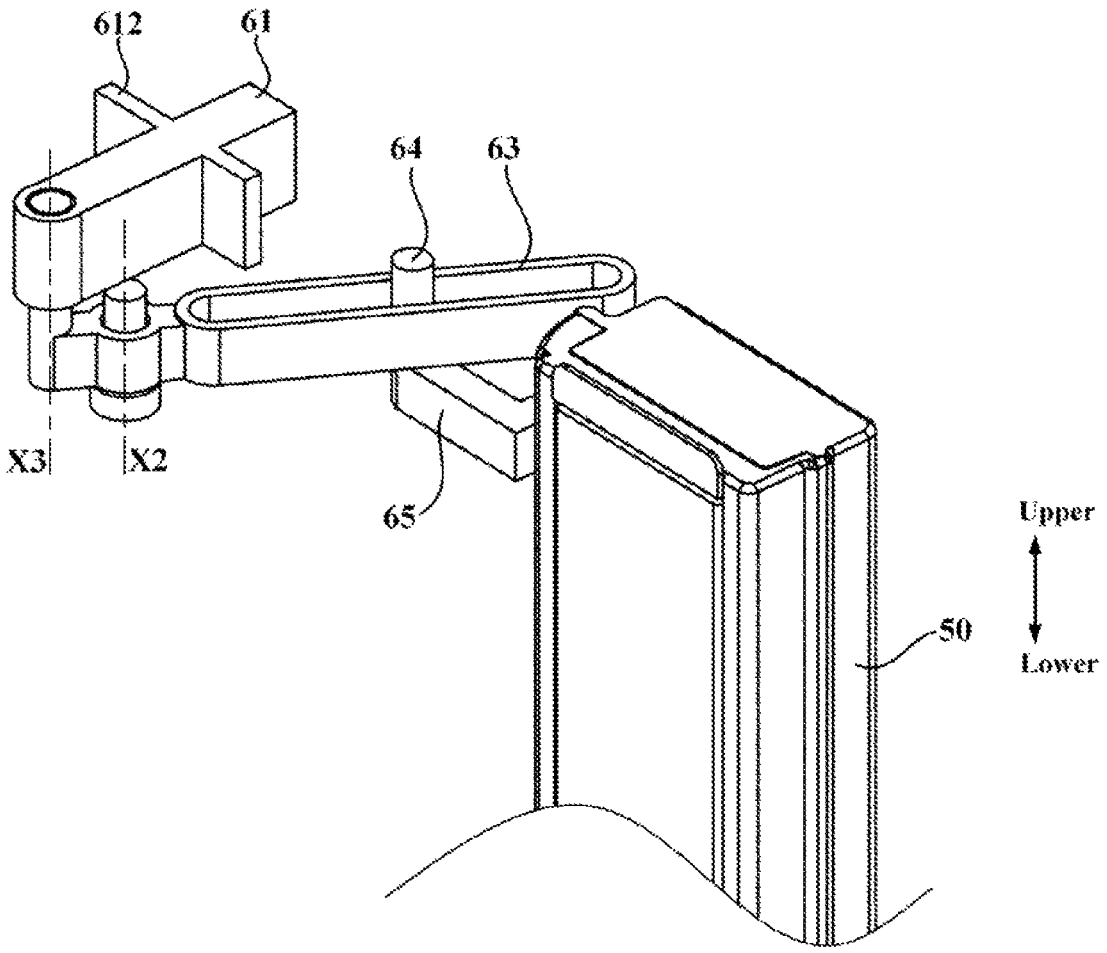
FIG. 6 is a schematic structural diagram of the driving mechanism and the vertical beam in FIG. 5.

FIG. 5 is an exploded schematic diagram of the refrigerator body 30, the first door body 10, the vertical beam 50 and the driving mechanism 60 in FIG. 1; and FIG. 6 is a schematic structural diagram of the driving mechanism 60 and the vertical beam 50 in FIG. 5.

As shown in FIG. 5 and FIG. 6, the telescopic member 61, the rotating member 63 and the connection rod 65 may be arranged in the vertical direction in a staggered manner, to avoid interference.

In some embodiments, as shown in FIG. 5 and FIG. 6, there may be two driving mechanisms 60, so that the two driving mechanisms 60 are matched with the top and the bottom of the vertical beam 50 respectively, and thus the vertical beam 50 is more evenly stressed in the up-down direction and rotates more smoothly. The upper and lower driving mechanisms 60 can be symmetrically disposed.

Hereto, those skilled in the art should realize that although a plurality of exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

What is claimed is:

1. A refrigerator, comprising a refrigerator body with an open front side, a first door body and a second door body that are rotatably disposed on the front side of the refrigerator body in a side-by-side manner, a vertical beam that is mounted at an open end of the first door body to be rotatable around a first vertical axis, and at least one driving mechanism, wherein the driving mechanism comprises:

a telescopic member, telescopically mounted on the first door body in the thickness direction of the first door body, to be at an extension position where the rear end of the telescopic member projects and extends out of the surface of the inner side of the first door body, or at a retraction position of retracting from the extension position to the interior of the first door body by a preset distance;

an elastic member, configured to apply an elastic force to the telescopic member to prompt same to move towards the extension position;

a rotating member, mounted on the first door body to be rotatable around a second vertical axis, and mounted on the telescopic member to be rotatable around a third vertical axis, wherein a sliding channel is formed in the rotating member; and a sliding column, directly or indirectly fixed to the vertical beam and slidable along the sliding channel; and the refrigerator is configured such that when the first door body is in an open state, the telescopic member is at the extension position, and the vertical beam is in a folded state attached to the inner side of the first door body; and during the closing of the first door body, the telescopic member is blocked by the refrigerator body and moves to the retraction position, to drive the rotating member to rotate around the second vertical axis, so that the sliding channel pushes the sliding column to drive the vertical beam to rotate to an unfolded state, so as to seal a gap between the first door body and the second door body.

2. The refrigerator according to claim 1, wherein the driving mechanism further comprises a connection rod, the connection rod is fixedly connected to the vertical beam and extends in a direction away from the vertical beam, and the sliding column is mounted at the end, away from the vertical beam, of the connection rod.

3. The refrigerator according to claim 2, wherein the end, close to the vertical beam, of the connection rod is rotatably mounted on the first door body so that the vertical beam rotates around the first vertical axis.

4. The refrigerator according to claim 2, wherein the telescopic member, the rotating member and the connection rod are arranged in the vertical direction in a staggered manner.

5. The refrigerator according to claim 1, wherein the second vertical axis, the third vertical axis and a central axis of the sliding column are coplanar; and the second vertical axis is located between the third vertical axis and the sliding channel.

6. The refrigerator according to claim 5, wherein the refrigerator is configured such that when the vertical beam is in the folded state, the sliding column abuts against the end, away from the second vertical axis, of the sliding channel in the length direction.

7. The refrigerator according to claim 5, wherein a ratio of the distance between the end, away from the second vertical axis, of the sliding channel in the length direction and the second vertical axis to the distance between the third vertical axis and the second vertical axis is greater than 5.

8. The refrigerator according to claim 1, wherein the rotating member comprises an oblong ring part, and the sliding channel is formed on the inner side of the ring part.

9. The refrigerator according to claim 1, wherein the telescopic member is provided with two lugs extending away from each other in the width direction of the first door body;

the first door body is provided with two limit grooves to accommodate the two lugs respectively; and there are two elastic members and both are compressed springs, each elastic member is connected between the rear surface of one lug and the rear wall of the corresponding limit groove, and when the telescopic member is in an extending state, the lugs abut against the front walls of the limit grooves under the action of the elastic forces of the elastic members.

10. The refrigerator according to claim 1, wherein there are two driving mechanisms, and the two driving mechanisms are matched with the top and the bottom of the vertical beam respectively.

* * * * *